US005483876A

United States Patent [19]

Davis et al.

[11] Patent Number: 5,483,876

[45] Date of Patent: Jan. 16, 1996

[54] WORKPART TRANSFER MECHANISM FOR STAMPING PRESS

[75] Inventors: Guy M. Davis, Elmira; Jack F. Herklotz; Kevin J. Lizenby, both of Traverse City, all of Mich.

[73] Assignee: Trantek, Incorporated, Traverse City, Mich.

[21] Appl. No.: 170,695

[22] Filed: Dec. 21, 1993

[51] Int. Cl.[6] ..... B30B 15/30

[52] U.S. Cl. ..... 100/207; 72/405; 198/468.6; 414/752

[58] Field of Search ..... 100/207, 215; 72/405; 198/468.4, 468.6; 414/225, 752

[56] References Cited

U.S. PATENT DOCUMENTS

| | | | |
|---|---|---|---|
| 3,233,751 | 2/1966 | Bannon | 100/207 |
| 3,312,463 | 4/1967 | Van Hoose et al. | 100/215 |
| 4,509,638 | 4/1985 | Kato et al. | 414/752 X |
| 4,523,889 | 6/1985 | Orii | 414/752 |
| 4,697,448 | 10/1987 | Stevens, Jr. et al. | 72/405 |
| 4,770,598 | 9/1988 | Kotani | 414/752 |
| 4,921,387 | 5/1990 | Bennington | 198/468.6 |
| 5,013,210 | 5/1991 | Bond | 414/752 |

FOREIGN PATENT DOCUMENTS

| | | | |
|---|---|---|---|
| 1170826 | 11/1969 | United Kingdom | 100/207 |
| 2134826 | 8/1984 | United Kingdom | 72/405 |
| 92/10360 | 6/1992 | WIPO | 100/215 |

*Primary Examiner*—Stephen F. Gerrity
*Attorney, Agent, or Firm*—Howard & Howard

[57] ABSTRACT

A workpart transfer assembly (10) shuttles workpart stampings from a forming die (14, 16) of one stamping press (12) to a remotely spaced successive forming die (14, 16) in another stamping press (12) while the two stamping presses (12) cycle in unison. The assembly (10) includes a base (18) stationed in a clearance between the two stamping presses (12). A dual drive and dual rail transfer shuttle (26) slides on the base (18) between two oppositely extending cantilever positions. A carriage (44) slides along the transfer shuttle (26). A dual screw drive mechanism drives the transfer shuttle (26) on the base (18) while at the same time driving the carriage (44) along the transfer shuttle (26), thereby effecting highly accelerated movement of the carriage. A lift screw mechanism is carried on the carriage (44) for raising and lowering a slide plate (60) during the shuttling operation. The slide plate (60), in turn, supports a pair of oppositely extending cantilevered arms (50) having suction cup ends (52) for grasping and releasing workparts to and from the forming dies (14, 16) and a central workpart rest platform (54).

26 Claims, 5 Drawing Sheets

24
24
18
22
10
20
44
84
82
76
46
62
46
26
28
88
86
32
70
30
58
56
80
86
48
52
50
88
60
46
46
50
52
52
72
54
52
52
48
22
24
24

56
58
64
60
68
48
50
72
60
88
88
86
44
52
86
82
78
46
46
26
28
40
40
34
34
38
38
36
36
74
84
76
42
42
18

WORKPART TRANSFER MECHANISM FOR STAMPING PRESS

TECHNICAL FIELD

The subject invention relates to a workpart transfer assembly for transferring workpart stampings from the forming die from one stamping press to a remotely spaced successive forming die in another stamping press while the two stamping presses cycle in unison.

BACKGROUND ART

In the sheet metal forming industry, stamping presses having forming dies are typically used to quickly and precisely shape a sheet metal workpart to the desired form. Automotive body parts such as deck lids, doors and quarter panels are usually formed in a stamping process. In many instances, it is not always prudent to shape the final workpart form in one stamping operation. Because of the physical properties of sheet metal and forming die construction practices, it is favored in many instances to form a workpart stamping in two or more successive forming operations. For large stampings, such as those automotive body pieces described above, separate and remotely spaced stamping presses must be employed in this successive forming operation.

In the early days of industry, such successively formed workpart stampings were manually transferred from the forming die of one stamping press to a remotely spaced successive forming die in another stamping press. Concerns for increased productivity and worker safety gradually introduced an automated shuttling process whereby the two stamping presses were synchronized to cycle in unison, with a mechanized workpart transfer assembly automatically plucking the workpart stamping from the forming die of a first stamping press and transferring that stamping to the remotely spaced forming die in a second or successive stamping press.

Examples of these prior art workpart transfer assemblies may be found in U.S. Pat. No. 4,509,638 to Kato et al, issued Apr. 9, 1985 and U.S. Pat. No. 4,523,889 to Orii, issued Jun. 18, 1985. These workpart transfer assemblies both include a stationary base positioned in a clearance space between the two stamping presses, and having some form of gripping members which reach into the respective stamping presses and alternately pluck a partially formed workpart stamping from one press and transfer it to the next successive forming die in the other stamping press. The primary deficiency of these workpart transfer assemblies reside in the relatively slow rate at which they operate. Slow operating rates require slowing of the stamping press cycle times, which in turn results in fewer workparts produced per hour.

Therefore, the workpart transfer assembly art is in need of a device which can rapidly shuttle workparts between two stamping presses with optimum reliability and of a simple construction to facilitate maintenance.

SUMMARY OF THE INVENTION AND ADVANTAGES

The subject invention relates to a workpart transfer assembly for shuttling workpart stampings from a forming die of one stamping press to a remotely spaced successive forming die in another stamping press while the two stamping presses cycle in unison. The assembly comprises a stationary base for disposition in a clearance space between the two stamping presses. An intermediate transfer shuttle is longitudinally slidably carried on the stationary base for reciprocating linear movement in the clearance space between the two stamping presses. A carriage is longitudinally slidably carried on the transfer shuttle for reciprocating linear movement therealong. A gripping means is supported on the carriage for alternately gripping and releasing workparts. The improvement of the invention comprises a longitudinal drive means for simultaneously driving the carriage along the transfer shuttle while driving the transfer shuttle in the same direction along the stationary base such that the carriage is displaced along the transfer shuttle a distance less than the relative displacement between the carriage and the stationary base.

The longitudinal drive means of the subject invention utilizes the compounding effect of relative movement so as to increase the speed at which workparts stampings are shuttled from one stamping press to the next without increasing the normal operating speed between the sliding members. In other words, the longitudinal drive means provides for highly accelerated operating speeds without over-taxing the individual sliding components.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
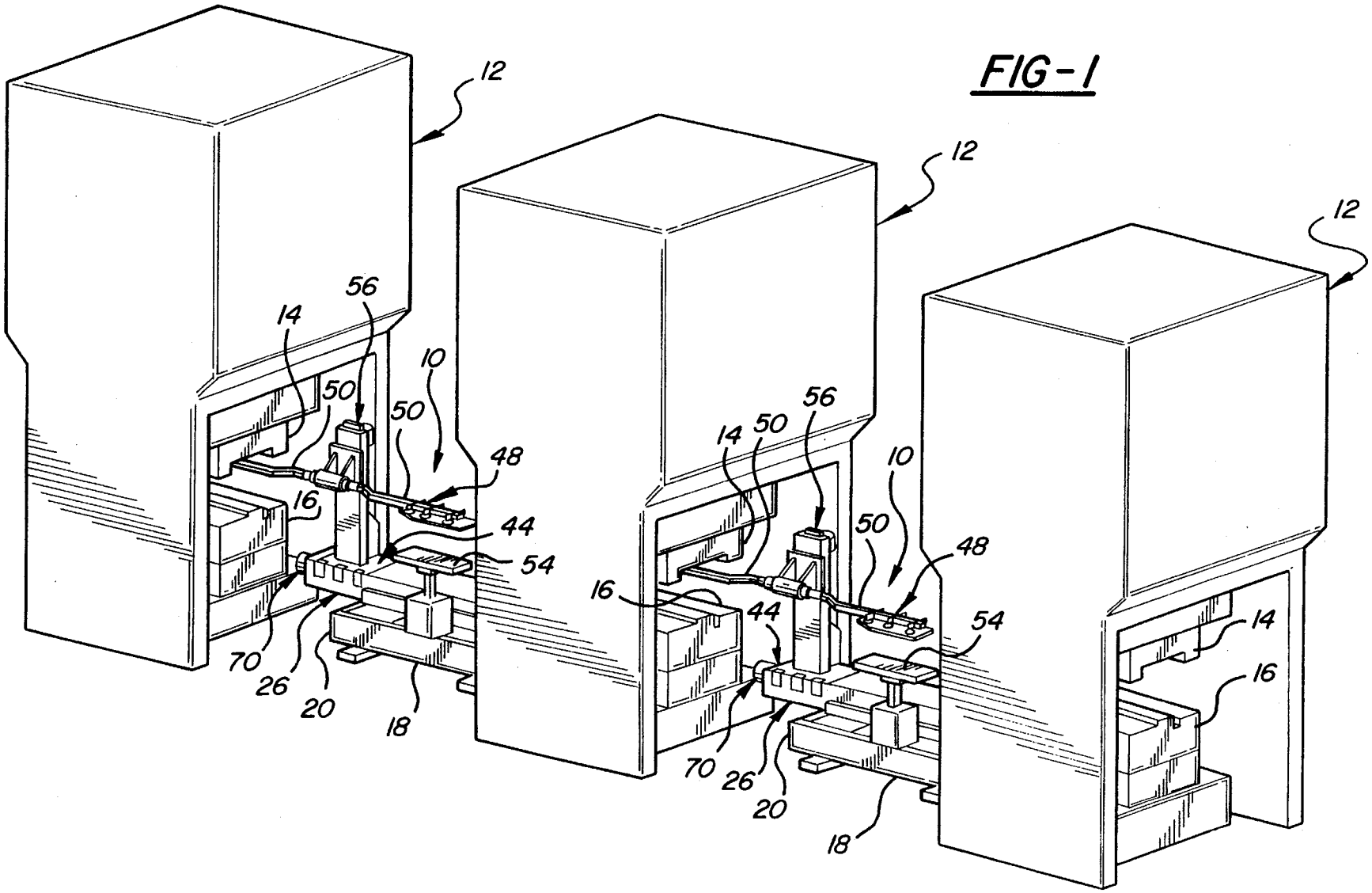
FIG. 1 is a perspective view showing two workpart transfer assemblies according to the subject invention positioned in the clearance spaces between three successive forming stamping presses having synchronized operating cycles.

Referring to the Figures, wherein like numerals indicate like or corresponding parts throughout the several views, a workpart transfer assembly according to the subject invention is generally shown at 10. In FIG. 1, two identical assemblies 10 are shown positioned in the clearance spaces between three stamping presses, generally indicated at 12. The stamping presses 12 each include upper and lower forming dies 14, 16, respectively, for shaping metal workparts. The forming dies 14, 16 between the three stamping presses 12, are constructed so as to successively form the workparts from an unfinished, or raw condition to a final finished shape. Typical workpart stampings include vehicular body parts such as quarter panels, deck lids, door skins and the like.

Because each stamping press 12 operates only one forming die set 14, 16, the workparts must be shuttled, or transferred, from one stamping press 12 to the next in the relatively short time interval in which the upper forming die 14 is lifted away from the lower forming die 16. To accomplish this transferring task in both a quick and orderly fashion, the numerous stamping presses 12 are all set to cycle in unison so that all of the upper forming dies 14 lift from the lower forming dies 16 at the same time and similarly press down upon the lower forming die 16 to stamp a new workpart. Therefore, the workpart transfer assemblies 10 are timed to operate in concert with the stamping presses 12 such that the workpart stampings shuttle in sequential, or cascade-like, fashion from one stamping press 12 to the next so that the stamping operation continues uninterrupted with maximum throughput.

Figure 2:
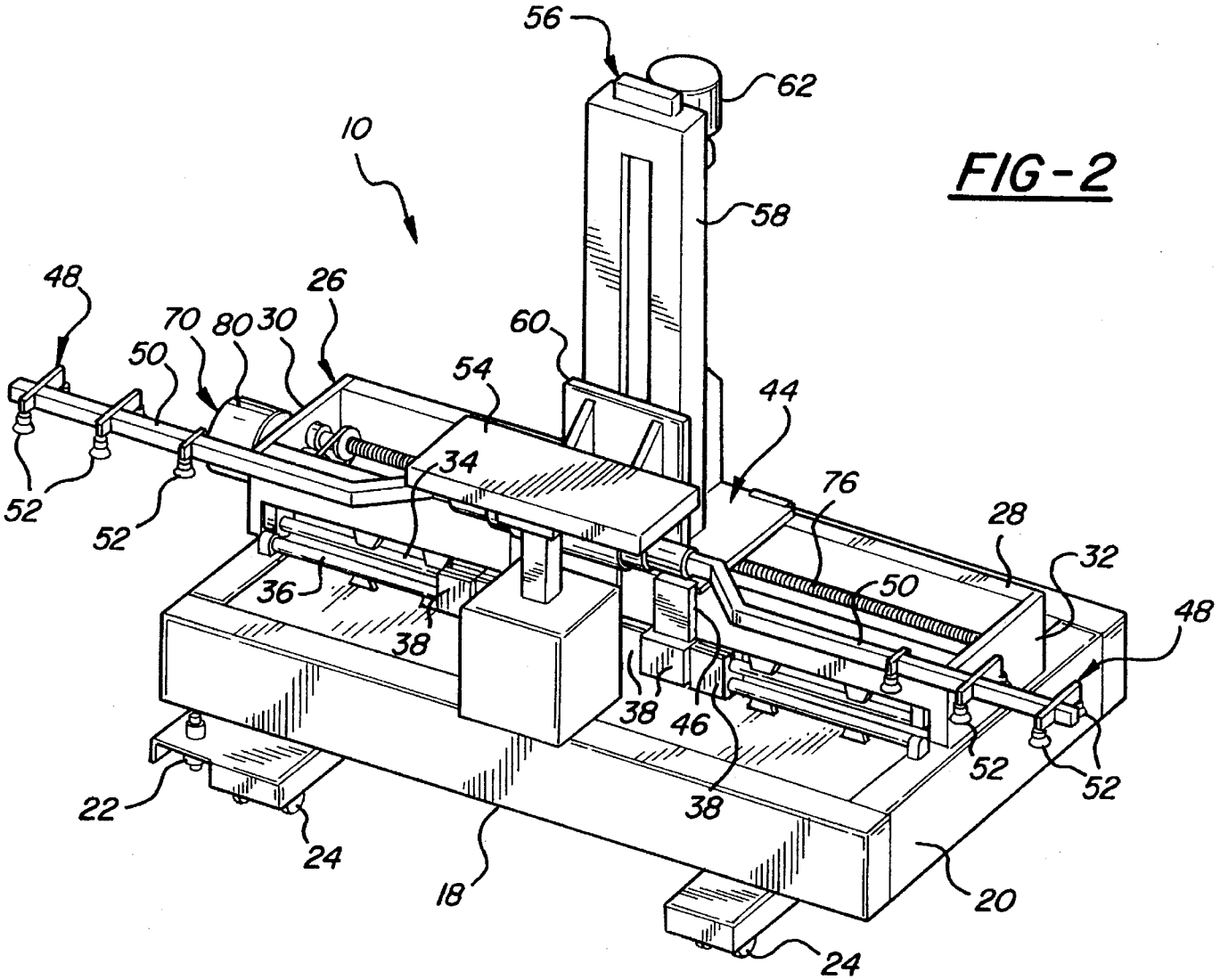
FIG. 2 is a perspective view of a workpart transfer assembly according to the subject invention.
Figure 3:
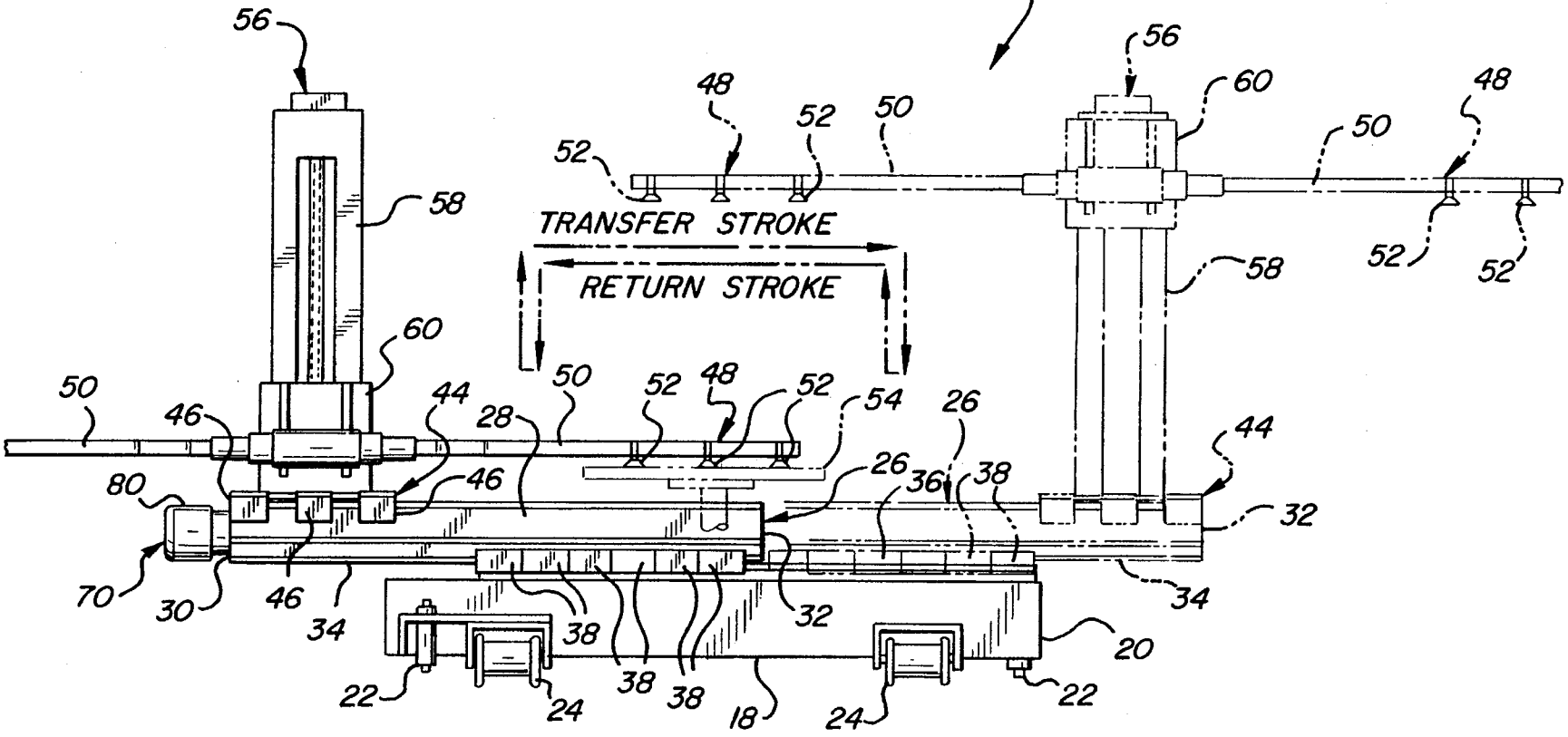
FIG. 3 is a front elevation view of the workpart transfer assembly according to the subject invention showing the transfer shuttle and carriage fully indexed to the left in solid and fully indexed to the right in phantom.

Referring now to FIGS. 2–5, a single workpart assembly 10 is shown. The assembly 10 includes a stationary base 18 for disposition in the clearance space between two adjacent stamping presses 12. The base 18 is a heavily constructed and rigid member having a generally rectangular frame 20 supported by rollers 24. As shown in FIG. 3, rollers 24 enable the assembly 10 to be easily positioned in the clearance space between two stamping presses 12 and removed from that clearance space for maintenance and repair. However, once the assembly 10 is positioned properly between two stamping presses 12, locating pins 22 are locked in place enabling the assembly 10 to be immovably locked in position between the two stamping presses 12.

The assembly 10 also includes an intermediate transfer shuttle, generally indicated at 26, which is longitudinally slidably carried on the stationary base 18 for reciprocating linear movement in the clearance space between the two stamping presses 12. In other words, the transfer shuttle 26 is driven to slide upon the base 18 in a linear path from one stamping press 12 to the other stamping press 12. The transfer shuttle 26 has an elongated rectangular shape formed by C-shaped frame members 28, best shown in FIG. 5. The transfer shuttle 26 is structured to have a pair of opposing ends 30, 32 which are alternately cantilevered from the stationary base 18 as the transfer shuttle 26 moves from one extreme longitudinally displaced position to the other. As shown in FIG. 3, the end 30 of the transfer shuttle 26 is cantilevered from the base 18 in one extreme longitudinally displaced position, and in phantom the other end 32 of the transfer shuttle 26 is shown in the other extreme longitudinally displaced position.

Although numerous constructions are possible for interconnecting the transfer shuttle 26 and the base 18 for longitudinal sliding movement, the preferred embodiment includes an upper guide tube 34 along each lateral side of the transfer shuttle 26, depending from the elongated frame members 28, and similarly a lower guide tube 36 parallel to the upper guide tube 34 fixed to the base 18. The upper 34 and lower 36 guide tubes are preferably of equally sized circular cross sections and formed of equal lengths.

At least one and preferably a plurality, of slidable bearing blocks 38 interconnect the upper 34 and lower 36 guide tubes. The bearing blocks 38 have upper 40 and lower 42 running channels surrounding the respective upper 34 and lower 36 guide tubes. The upper 40 and lower 42 running channels have an inner surface fabricated from a hardenable polymeric material to reduce sliding friction and increase bearing block life. These polymeric running channels 40, 42 can be formed after the manner of the nut casting methods disclosed in U.S. Pat. No. 4,790,971, issued Dec. 13, 1988 and U.S. Pat. No. 5,223,158, issued Jun. 29, 1993, both assigned to the assignee of the subject invention and the disclosures of which are hereby incorporated by reference. In operation, as the transfer shuttle 26 is slid from one extreme cantilevered position to the other along the base 18, the plurality of bearing blocks 38 slide between ends of the two guide tubes 34, 36 and function to stably support the transfer shuttle 26 in its cantilevered position from the base 18.

Figure 5:
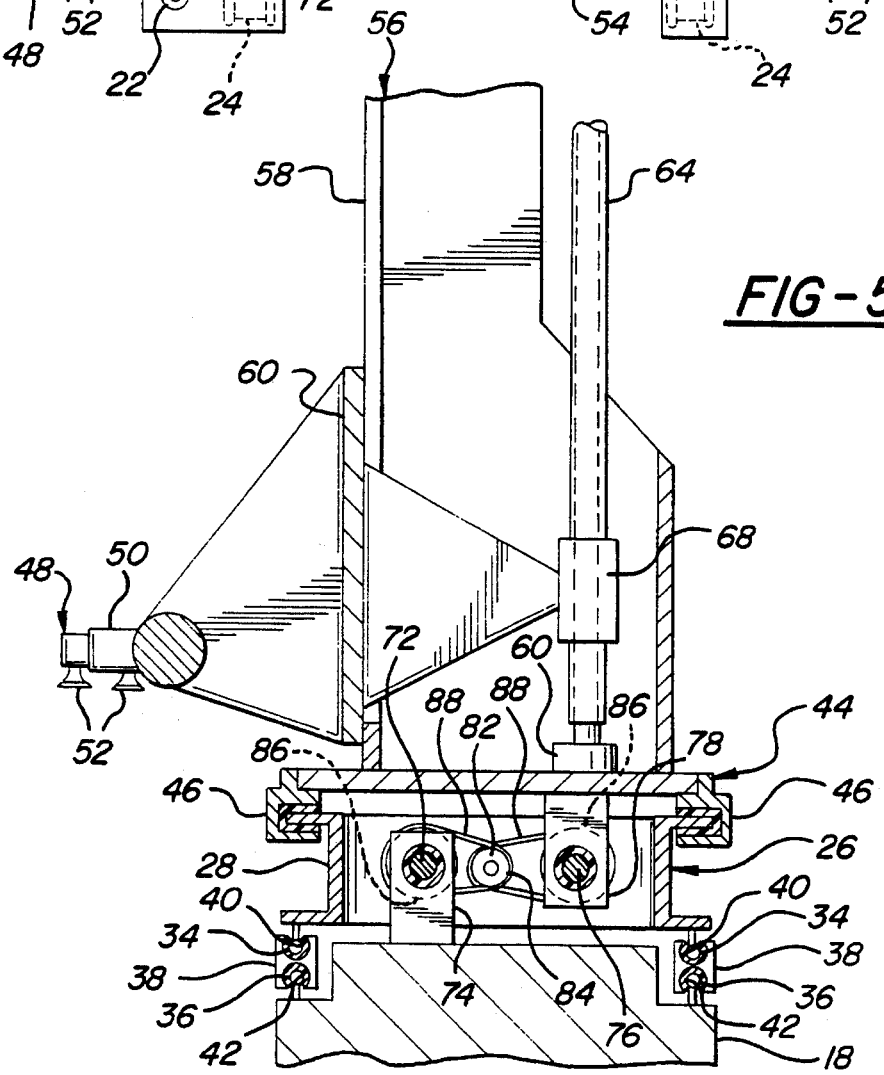
FIG. 5 is a fragmentary cross-sectional view taken along lines 5—5 of FIG. 4.

The assembly 10 further includes a carriage, generally indicated at 44, which is longitudinally slidably carried on the transfer shuttles 26 for reciprocating linear movement therealong. The carriage 44 slides along the transfer shuttle 26 while the transfer shuttle 26 is sliding along the base 18. This is perhaps best illustrated in FIG. 3 where the carriage 44 and transfer shuttle 26 are shown displaced to the full left position, and in phantom are shown displaced in the full right position. The carriage 44 is a generally plate-like member, which, in the embodiment shown in FIG. 5, is slidably connected to the upper flanges of the transfer shuttle frame 28 by wrap around appendages 46. These wrap around appendages 46 are shown in FIG. 5 having an inner sliding surface fabricated from the same hardenable polymeric material as that of the running channels 40, 42 in the bearing blocks 38. However, it will be readably appreciated by those skilled in the art that the wrap around appendage construction 46 shown in FIG. 5 is only one of many mechanically equivalent alternative construction for slidably connecting the carriage 44 to the transfer shuttle 26. For example, roller wheels could also be used.

A gripping means, generally indicated at 48 in FIGS. 2–5, is supported on the carriage 44 for alternately gripping and releasing the workpart stampings from the forming dies 14, 16 of the stamping presses 12. In the preferred embodiment shown in the accompanying Figures, the gripping means includes a pair of oppositely extending arms 50 cantilevered from the carriage 44. The arms 50 extend in the same direction as the sliding direction of both the transfer shuttle 26 and carriage 44. The arms 50 each include a plurality of suction cups 52 at their distal ends for attaching to the workparts. It is important to note that the cantilevered length of the arms 50 never changes throughout the shuttling operation.

Referring to FIGS. 1 and 3, the gripping means 48 extends well out from the base 18 to reach in between the upper 14 and lower 16 forming dies of one stamping press and then descends upon a workpart in the lower forming die 16 until the suction cups 52 adhere to the workpart. The arms 50 are then raised relative to the carriage 14 so that the workpart is lifted from the lower forming die 16. Thereupon, the carriage 44 and transfer shuttle 26 are simultaneously fully indexed to the other extreme cantilevered position relative to the base 18, as shown in phantom in FIG. 3, where the newly grasped workpart is laid to rest upon a rest nest 54. The automatic positioning rest nest 54 extends fixedly from the base 18, and can be programmed for automatic adjustment for both angle and elevation to facilitate transfer to the next stamping press 12. The suction cups 52 then release the workpart onto the automatic positioning rest nest 54. As the carriage 44 and transfer shuttle 26 begin moving back to the initial position, i.e., the extreme left cantilever position as shown in FIGS. 1 and 3, the stamping presses 12 all cycle in unison to shape their respective workparts.

As the upper forming dies 14 begin moving upwardly from the lower forming dies 16, the arms 50 extend into the forming die area and descend upon the workpart therein until the suction cups 52 adhere to the workpart. Simultaneously, however, the suction cups 52 on the other, oppositely extending, arm 50 of the gripping means 48 descends upon and adheres to the workpart resting on the automatic positioning rest nest 54. The workpart on the automatic positioning rest nest 54 is therefore also grasped and lifted away from the automatic positioning rest nest 54 simultaneously with the workpart lifted from the lower forming die 16. As the carriage 44 and transfer shuttle 26 then simultaneously index to the fully right cantilevered position (shown in phantom in FIG. 3) the workpart that was located on the automatic positioning rest nest 54 is lowered into the forming dies 14, 16 of the next adjacent stamping press 12 while the workpart picked from the first stamping press 12 is laid to rest upon the automatic positioning rest nest 54. This cycle continues in an endless fashion so that workparts are continually fed from one stamping press 12 to the next with an intermediate workpart deposited upon the automatic positioning rest nest 54. By adjusting the relative positions of each of the two arms 50 and the automatic positioning rest nest 54, workparts can be shuttled between two stamping presses 12 having forming die sets 14, 16 at different elevations and angles.

Figure 4:
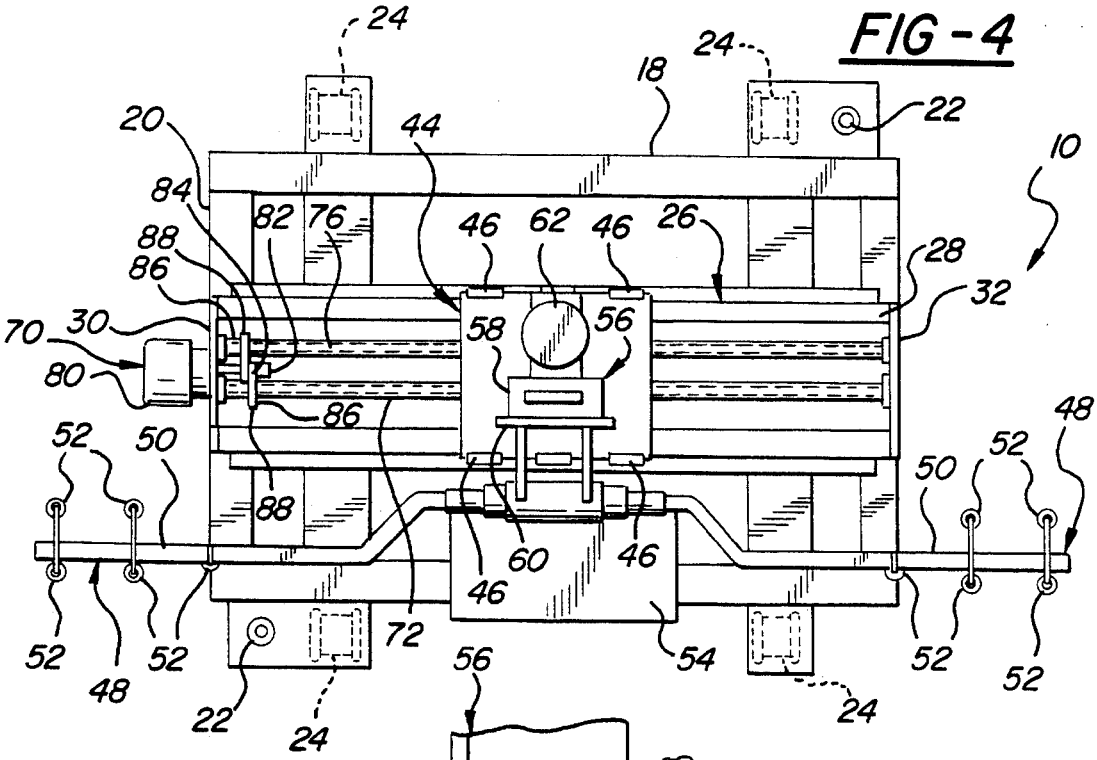
FIG. 4 is a top view of the workpart transfer assembly.

An elevator means, generally indicated at 56 in FIGS. 2, 4 and 5, is provided for vertically moving the gripping means 48 relative to the carriage 44. The elevator means 56 may take any of various forms well known in the art, e.g., chain driven or pneumatic/hydraulic cylinders, however preferably includes a lift screw mechanism. More specifically, the elevator means 56 of the preferred embodiment includes a guide tower 58 extending vertically from the carriage 44, and a slide plate 60 in vertically guided contact with the guide tower 58. The slide plate 60 is fixedly attached to the gripping means 48. The lift screw mechanism includes a lift drive motor 62 fixed relative to the guide tower 58. As shown in the Figures, the lift drive motor 62 is supported adjacent the upper end of the guide tower 58. An elongated lift screw spindle 64 is rotatably supported adjacent the guide tower 58 and operatively coupled to the lift drive motor 62 for rotation thereby. That is, the lift screw spindle 64 may be connected directly to the lift drive motor drive shaft (not shown) in a direct drive configuration. The lower end of the lift screw spindle 64 may be supported in a bearing cup 66, as shown in FIG. 5.

To achieve the necessary control required in these transfer operations, the lift drive motor 62 must be reversible and capable of precise revolution control. To achieve these goals, the lift drive motor 62 may be of the servo motor type. As will be appreciated by those skilled in the art, appropriate electronic controls (not shown) are necessary to issue commands for the lift drive motor 62 operation, as well as controlling all other motions of the assembly 10.

The slide plate 60 includes an attached travelling lift nut 68 operatively threadably engaging the lift screw spindle 64. Thus, as best shown in FIG. 5, as the lift screw spindle 64 is rotated, the slide plate 60 is moved up and down the guide tower 58 via displacement of the lift nut 68. The lift nut 68 may include thread forms constructed of a hardenable polymeric material, fashioned after the method disclosed in either one of U.S. Pat. Nos. 4,790,971 and 5,223,158. Of course, the slide plate 60 may be connected to the guide tower 58 for guided rolling movement in any one of various ways, including a guided track and roller assembly (not shown) or the like.

A longitudinal drive means, generally indicated at 70 in FIGS. 4 and 5, simultaneously drives the carriage 44 along the transfer shuttle 26 while also driving the transfer shuttle 26 in the same direction along the stationary base 18 so that the carriage 44 is displaced along the transfer shuttle 26 a distance less than the relative displacement between the carriage 44 and the stationary base 18. In this manner, the carriage 44 is rapidly shuttled between its two extreme positions, shown in FIG. 3, while the drive mechanism accomplishing this rapid shuttling operates at a relatively low speed. Said another way, if the rate of displacement between the carriage 44 and the base 18 is considered full speed, the actual rate of displacement between the sliding members of the carriage 44 and the transfer shuttle 26 is only half speed, while the rate of displacement between the transfer shuttle 26 and the base 18 is half speed. These two half speed rates combine to drive the carriage 44, in relative terms, at a full speed rate compared to the stationary base 18. That is, the speed of the carriage 44 along the transfer shuttle 26 is additive with the speed of the transfer shuttle 26 along the base 18 to result in an apparent actual speed of carriage 44 relative to the base 18 which is the sum of the two component speeds.

The longitudinal drive means 70 preferably includes a screw drive mechanism. The screw drive mechanism is best shown in FIGS. 4 and 5 including a transfer shuttle screw spindle 72 rotatably mounted on the transfer shuttle 26. A base nut 74 is fixed to the base 18 and threadably engages the transfer shuttle screw spindle 72. Thus, as the transfer shuttle screw spindle 72 rotates under power, the stationary base nut 74 causes a linear translation of the transfer shuttle screw spindle 72 thereby displacing the transfer shuttle 26.

Likewise, the screw drive mechanism also includes a carriage screw spindle 76 rotatably mounted on the transfer shuttle 26 adjacent the transfer shuttle screw spindle 72. A carriage nut 78 is fixed to the bottom of the carriage 44 and threadably engages the carriage screw spindle 76. Therefore, as the carriage screw spindle 76 rotates under power, the carriage nut 78, which is fixed to the bottom of the carriage 44, translates linearly along the carriage screw spindle 76 and the accompanying transfer shuttle 26. A motor 80 is mounted on a transfer shuttle 26 and is operatively coupled to each of the screw spindles 72, 76 for rotating the screw spindles 72, 76 under power. The motor 80, like the lift drive motor 62, must be reversible and capable of precision electronic control. Thus, the two screw spindles 72, 76 are held parallel to each other within the elongated rectangular frame 28 of the transfer shuttle 26 with bearings at each end to allow free rotation of the two screw spindles 72, 76 by the motor 80. Although it is not necessary, the two screw spindles 72, 76 of the subject invention have corresponding screw threads of equal pitch and lead and are coextensive with each other. Unequal pitch and lead combinations may be desirable in some instances to achieve ideal displacement speeds of the carriage 44.

The motor 80 may include a clutch 82 connected to its drive shaft, with a pair of pulley sheaves 84 extending from the clutch 82. Each of the screw spindles 72, 76 also includes a pulley sheave 86 around which a drive belt 88 is placed for simultaneously rotating both screw spindles 72, 76 from the motor sheaves 84. The drive belts 88 may be toothed to prevent slippage, or in the alternative may be of chain type construction. Those skilled in the art will readily understand numerous other alternative constructions for connecting the motor 80 and the two screw spindles 72, 76 for simultaneous rotation of both screw spindles 72, 78 so the carriage 44 is driven along the transfer shuttle 26 while the transfer shuttle 26 is driven along the base 18. If an alternative connection between the motor 80 and the two screw spindles 72, 76 causes opposite directions of rotation between the two screw spindles 72, 76, the screw thread direction of one of the screw spindles 72, 76 can be reversed, i.e., to left-handed, to achieve proper carriage 44 traveling speed.

Figure 6:
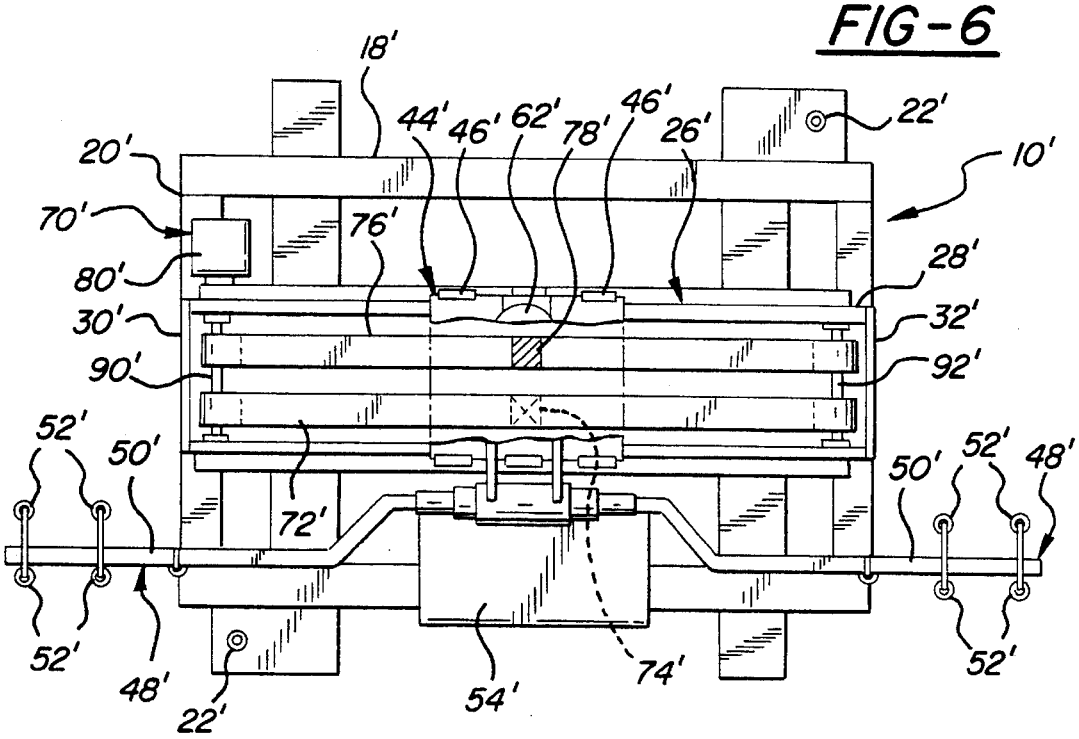
FIG. 6 is a view as in FIG. 4 of a first alternative embodiment of the longitudinal drive means.

FIG. 6 shows a first alternative embodiment of the longitudinal drive means 70'. For convenience, like and corresponding structures to those described above are indicated with reference to FIG. 6 using single prime designations. The alternative longitudinal drive means 70' yields the same functional output as the preferred embodiment of FIGS. 1–5, however utilizes a belt drive mechanism instead of a screw drive mechanism. More particularly, an endless transfer shuttle belt 72' and an identical endless carriage belt 76' are supported between a drive pulley shaft 90' and a driven pulley shaft 92'. The belts 72', 76' may be toothed to prevent slippage about the respective pulley shafts 90', 92'. A motor 80' is operatively coupled to the drive pulley shaft 90' so that both belts 72, 76' are driven simultaneously and at the same speed. Of course, other drive connection options are possible, with that shown in FIG. 6 being merely the most convenient.

A base lug 74' is attached to the bottom of the shuttle transfer belt 72' and also to the base 18'. Therefore, movement of the shuttle transfer belt 72' causes the transfer shuttle 26' to slide along the base 18'. Likewise, a carriage lug 78' is attached to the top of the carriage belt 76' and also to the carriage 44' so that movement of the carriage belt 76' slides the carriage 44' along the transfer shuttle 26'. Those skilled in the art will readily appreciate other variations of this concept, such as the substitution of endless chain for the belts 72', 76'.

Figure 7:
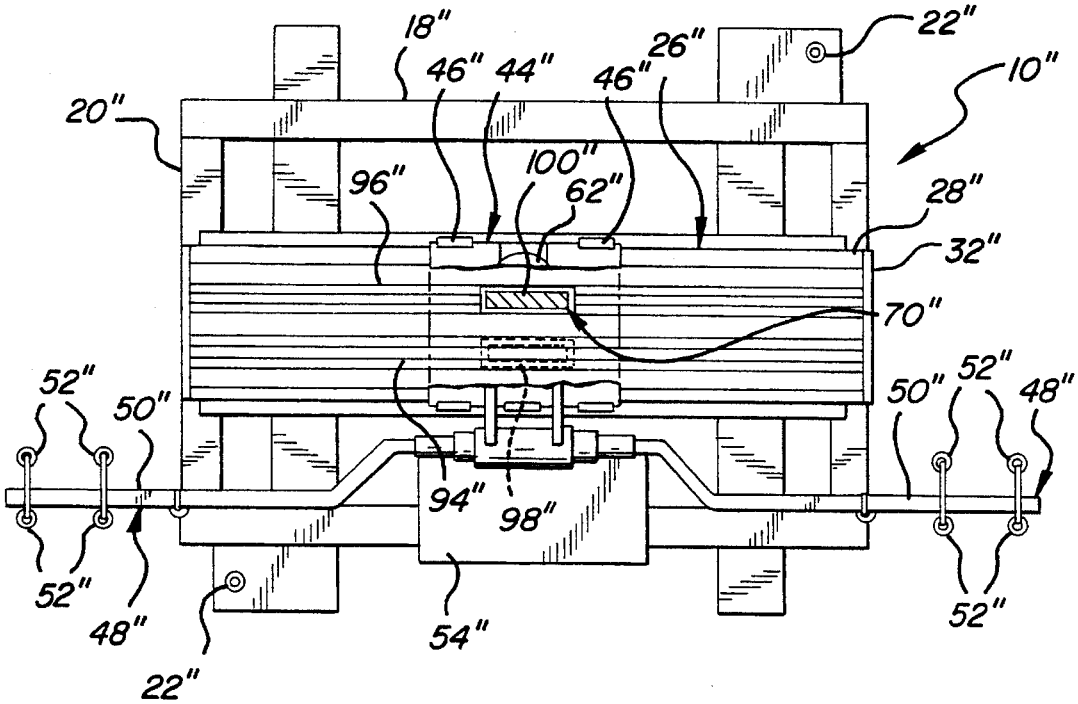
FIG. 7 is a view as in FIG. 6 of a second alternative embodiment of the longitudinal drive means.

In FIG. 7, a second alternative embodiment of the longitudinal drive means is shown at 70". Double prime designations are used in FIG. 7 to indicate corresponding features described above. The longitudinal drive means 70" of FIG. 7 includes a linear actuator construction to achieve the desired function of simultaneously driving the carriage 44" along the transfer shuttle 26" while driving the transfer shuttle 26" in the same direction along the stationary base 18" so that the carriage 44" is displaced along the transfer shuttle 26" a distance less than the relative displacement between the carriage 44" and the base 18".

In this alternative embodiment, there is provided an elongated transfer shuttle track 94" and an elongated carriage track 96" supported parallel to each other within the frame 28" of the transfer shuttle 26". A base actuator 98" is fixed to the base 18" and operatively engages the bottom of the shuttle transfer track 94". Similarly, a carriage actuator 100" is fixed to the carriage 44" and operatively engages the top of the carriage track 96". When power is supplied to the actuators 98" 100" they are driven linearly along their respective tracks 94" 96" such that the fixed base actuator 98" shifts the entire transfer shuttle 26" and the carriage actuator 100" drives the attached carriage 44" along the top of the transfer shuttle 26".

The actuators 98", 100" may be responsive to any one of several power sources. For example, the actuators 98", 100" may operate on compressed air, pressurized fluid or electricity, each being well known in the art. The rodless cylinder components marketed by the OREGA Corporation, of Elmhurst, Ill., will provide satisfactory results.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A workpart transfer assembly (10) for shuttling unfinished workpart stampings from a forming die (14, 16) of one stamping press (12) to a remotely spaced successive forming die (14, 16) in another stamping press (12) while the two stamping presses (12) cycle in unison, said assembly (10) comprising: a stationary base (18) for disposition in a clearance space between the two stamping presses (12); an intermediate transfer shuttle (26) longitudinally slidably carried on said stationary base (18) for reciprocating linear movement in the clearance space between the two stamping presses (12) between extreme longitudinally displaced positions and having a pair of opposing ends (30,32) alternately cantilevered from said base (18) as said transfer shuttle (26) moves from one extreme longitudinally displaced position to another; a carriage (44) longitudinally slidably carried on said transfer shuttle (26) for reciprocating linear movement therealong; gripping means (48) supported on said carriage (44) for alternately gripping and releasing workparts; and longitudinal drive means (70) for simultaneously driving said carriage (44) along said transfer shuttle (26) while driving said transfer shuttle (26) in the same direction along said stationary base (18) such that said carriage (44) is displaced along said transfer shuttle (26) a distance less than the relative displacement between said carriage (44) and said base (18).

2. An assembly as set forth in claim 1 further including elevator means (56) for vertically moving said gripping means (48) relative to said carriage (44).

3. An assembly as set forth in claim 2 wherein said elevator means (56) includes a lift screw mechanism.

4. An assembly as set forth in claim 3 wherein said elevator means includes a guide tower extending vertically from said carriage (44) and a slide plate (60) in vertically guided contact with said guide tower (58) and fixedly connected to said gripping means (48),

5. An assembly as set forth in claim 4 wherein said lift screw mechanism includes a lift drive motor (62) fixed relative to said guide tower (58), and an elongated lift screw spindle (64) rotatably supported relative to said guide tower (58) and operatively coupled to said lift drive motor (62) for rotation thereby.

6. An assembly as set forth in claim 5 wherein said slide plate (60) includes a traveling lift nut (68) operatively threadably engaging said lift screw spindle (64).

7. An assembly as set forth in claim 1 further including a central automatic positioning rest nest (54) extending from said base (18).

8. An assembly as set forth in claim 7 wherein said gripping means (4S) includes a pair of oppositely extending arms (50).

9. An assembly as set forth in claim 8 wherein said arms (50) are cantilevered a fixed distance from said carriage (44).

10. An assembly as set forth in claim 9 wherein said arms (50) each include a suction cup (52) at the distal end thereof.

11. An assembly as set forth in claim 1 wherein said longitudinal drive means (70) includes a screw drive mechanism.

12. An assembly as set forth in claim 11 wherein said screw drive mechanism includes a transfer shuttle screw spindle (72) rotatably mounted on said transfer shuttle (26) and a base nut (74) fixed to said base (18) and threadably engaging said transfer shuttle screw spindle (72).

13. An assembly as set forth in claim 12 wherein said screw drive mechanism includes a carriage screw spindle (76) rotatably mounted on said transfer shuttle (26) adjacent said transfer shuttle screw spindle (72) and a carriage nut (78) fixed to said carriage (44) and threadably engaging said carriage screw spindle (76).

14. An assembly as set forth in claim 13 wherein said screw drive mechanism includes a motor (80) mounted on said transfer shuttle (26) and operatively coupled to each of said screw spindles (72, 76) for rotating said screw spindles (72, 76) relative to said transfer shuttle (26).

15. An assembly as set forth in claim 14 wherein said screw spindles (72, 76) are parallel.

16. An assembly as set forth in claim 15 wherein said screw spindles (72, 76) have corresponding screw threads of equal pitch and lead.

17. An assembly as set forth in claim 15 wherein said screw spindles (72, 76) are coextensive.

18. An assembly as set forth in claim 15 wherein each of said base (74) and carriage (78) nuts have thread forms fabricated from a hardenable polymeric material.

19. An assembly as set forth in claim 14 wherein said transfer shuttle (26) has an upper guide tube (34) and said base (18) has a lower guide tube (36) parallel to said upper guide tube (34), and at least one slidable bearing block (38) interconnecting said upper (34) and lower (36) guide tubes.

20. An assembly as set forth in claim 19 wherein said bearing block (38) has upper (40) and lower (42) running channels having respective inner surfaces fabricated from a hardenable polymeric material.

21. An assembly as set forth in claim 1 wherein said longitudinal drive means (70') includes a belt drive mechanism.

22. An assembly as set forth in claim 21 wherein said belt drive mechanism includes a transfer shuttle belt (72') and a carriage belt (76') operatively supported between a drive pulley shaft (90') and a spaced driven pulley shaft (92') on said transfer shuttle (26').

23. An assembly as set forth in claim 1 wherein said longitudinal drive means (70") includes a linear actuator mechanism.

24. An assembly as set forth in claim 23 wherein said linear actuator mechanism includes an elongated transfer shuttle track (94") and a parallely spaced elongated carriage track (96") supported on said transfer shuttle (26").

25. An assembly as set forth in claim 24 further including a base actuator (98') fixed to said base (18") and operatively engaging said transfer shuttle track (94") and a carriage actuator (100") fixed to said carriage (44") and operatively engaging said carriage track (96").

26. A workpart transfer assembly (10) and stamping press (12) combination for shuttling unfinished workpart stampings from a forming die (14, 16) of one stamping press (12) to a remotely spaced successive forming die (14, 16) in another stamping press (12) while the two stamping presses (12) cycle in unison, said combination comprising: a first stamping press (12) having upper (14) and lower (16) forming dies; a second stamping press (12) having upper (14) and lower (16) forming dies and spaced from said first stamping press (12) across a clearance space; a stationary base (18) disposed in said clearance space; a central automatic positioning rest nest (54) extending from said base (18); an intermediate transfer shuttle (26) longitudinally slidably carried on said stationary base (18) for reciprocating linear movement in said clearance space, said intermediate transfer shuttle (26) having a pair of opposing ends (30, 32) alternately cantilevered from said base (18) as said transfer shuttle (26) moves from one extreme longitudinally displaced position to another; a carriage (44) longitudinally slidably carried on said transfer shuttle (26) for reciprocating linear movement therealong; a pair of oppositely extending arms (50) cantilevered a fixed distance from said carriage (44) for alternately gripping and releasing workparts; elevator means (56) for vertically moving said arms (50) relative to said carriage (44); and longitudinal drive means (70) for simultaneously driving said carriage (44) along said transfer shuttle (26) while driving said transfer shuttle (26) in the same direction along said stationary base (18) such that said carriage (18) is displaced along said transfer shuttle (26) a distance less than the relative displacement between said carriage (44) and said base (18), said longitudinal drive means (70) including a transfer shuttle screw spindle (72) rotatably mounted on said transfer shuttle (26) and a base nut (74) fixed to said base (18) and threadably engaging said transfer shuttle screw spindle (72), and a carriage screw spindle (76) rotatably mounted on said transfer shuttle (26) adjacent said transfer shuttle screw spindle (72) and a carriage nut (78) fixed to said carriage (44) and threadably engaging said carriage screw spindle (76), and a motor (80) mounted on said transfer shuttle (26) and operatively coupled to each of said screw spindles (72, 76) for rotating said screw spindles (72, 76) relative to said transfer shuttle (26).

* * * * *